United States Patent [19]

Scott

[11] 4,134,348

[45] Jan. 16, 1979

[54] YARN FEED ROLLER ASSEMBLY

[75] Inventor: Jimmie D. Scott, Harrison, Tenn.

[73] Assignee: Spencer Wright Industries, Inc., Chattanooga, Tenn.

[21] Appl. No.: 880,188

[22] Filed: Feb. 22, 1978

[51] Int. Cl.[2] ..... D05C 15/00

[52] U.S. Cl. ..... 112/79 R; 112/79 A; 226/108

[58] Field of Search ..... 112/79 R, 79 A; 226/30, 226/31, 108

[56] References Cited

U.S. PATENT DOCUMENTS 3,103,903 9/1963 Broadrick et al. ..... 112/79 R

*Primary Examiner*—Ronald Feldbaum

*Attorney, Agent, or Firm*—Alan Ruderman

[57] ABSTRACT

A yarn feed roller assembly for a tufting machine pattern attachment for controlling the amount of yarn supplied to the needles of the machine in accordance with a pattern. The assembly includes a plurality of roller sets, each roller of the set having an inner race secured for rotation to a shaft driven at a different speed than the other rollers of the set. The roller also has an outer race journally supported on the inner race for rotation relative thereto. The outer race has a toothed ring at the inner circumference and the inner race carries a plurality of toothed segments adapted for coupling engagement with the ring to drive the outer race. The segments are comprised of magnetic material and an external magnetic field is selectively energized to attract the segments of one or the other rollers into engagement with its ring to feed yarn at the rate of the selected roller.

17 Claims, 6 Drawing Figures

YARN FEED ROLLER ASSEMBLY

BACKGROUND OF THE INVENTION

This invention relates to textile machinery, such as tufting machines and the like, and is particularly directed to yarn feed roller pattern attachments therefor.

Wide use is being made of yarn feed roller pattern attachments for producing variations in pile height in pile fabrics such as carpeting. Representative of such feed roller pattern attachments are those disclosed in the following U.S. Pat. Nos. Card, No. 2,862,465; Nix, No. 2,875,714; Card, No. 2,966,866; MacCaffray, No. 3,001,388; Card, No. 3,075,482; Hammel, No. 3,103,187; Beasley, No. 3,134,529; Erwin, et al, No. 3,272,163; Singleton, No. 3,489,326; Short, No. 3,605,660; Short, No. 3,752,094; Hammel, No. 3,847,098; Lear et al, No. 3,926,132 and Prichard et al, No. 3,955,514. These attachments include a plurality of yarn feed rollers which feed yarn to the needles of the tufting machine. Each of the feed rollers is selectively driven at one of a plurality of different speeds independently of the other feed rolls by means of clutches controlled by a pattern control. The amount of yarn supplied to the needles of a tufting machine is determined by the rotational speed of the feed rollers about which the yarn is wound, so that with a fixed needle stroke the amount of yarn supplied to the needle determines the pile height of the fabric produced. To create patterned pile effects the amount of yarn fed to the individual needles may be varied by driving the feed rollers selectively at the different speeds.

Since each needle receiving yarn from a given roller must necessarily always produce a pile loop as the same height as that of the other needles receiving yarn from that roller, the number of pattern repeats across the width of the work product is limited by the number of needles receiving yarn from each roller. Thus, the limitations on the number of rollers restricts the carpet designer to designs which repeat frequently across the width of the carpet. It is therefore desirable to have a pattern attachment capable of individual yarn end control or at least approaching such control. Due to space limitations the prior art designs have not generally been adoptable to the large number of rollers required for individual yarn end control. The Short patents and the Prichard et al patent are attempts toward this end, however these necessitate complicated drive constructions.

The most successful prior art feed roller attachments have been those, such as illustrated in the aforesaid Singleton, Hammel No. 3,847,098 and Lear et al patents, in which the rollers are journalled on driven shafts and electromagnetic clutch elements are mounted within the rollers for drivingly transmitting the rotation of the shaft to the rollers selectively. However, because the electromagnetic clutches include electrical coils and other wiring within the rollers, the rollers are relatively wide and limits the number of rollers that can be utilized. Moreover, since these feed roller attachments comprise a large number of such clutches, and since certain of the clutch elements have a relatively short life, frequent servicing of the roller units has been occassioned.

SUMMARY OF THE INVENTION

The present invention overcomes these problems of the prior art by providing a yarn feed roller assembly of a very compact and simple construction. The problems associated with the electromagnetic clutch elements are eliminated since the electromagnetic clutches are eliminated. Each yarn feed roller comprises an inner race fixed for rotation on a driven shaft, an outer race journally supported on the inner race and having an internal drive coupling member, and a plurality of drive coupling segments carried by the inner race and selectively actuated radially into coupling engagement with the internal drive coupling member of the outer race for driving the outer race. Yarn is wound about the periphery of two or more outer races of a roller set, the inner races of which are driven at different speeds, and the yarn is fed to the needles at a rate determined by the speed of the inner race whose sements are actuated. The outer race of each roll of the roller set will thus rotate together with or relative to its inner race at the speed of one or the other of the drive shafts.

In carrying out the principles of the invention the internal drive coupling member comprises a ring having internally facing teeth fixed to the outer race, while the drive coupling members comprise peripherally toothed segments carried in slots in the inner race normally biased toward the axis of the driven shaft and selectively movable radially outwardly into driving engagement with the teeth of the ring. The toothed segments are comprised of magnetic materal and are moved radially by magnetic means disposed externally of the races. The application of the magnetic force to the segmental coupling members is controlled by a conventional pattern control. When the speed of a drive shaft is selected, the magnetic force is applied to actuate the toothed segments of the inner race mounted on that shaft. Since there are no electrical elements within the rollers, the rollers are exceptionally thin axially and have the prospect of less frequent and simpler servicing.

Accordingly, it is a primary object of the present invention to provide an improved yarn feed roller that is axially narrower than heretofore possible.

It is another object of the present invention to provide a yarn feed roller that has no internal electrical elements.

It is a further object of this invention to provide a yarn feed roller of a simple and compact construction.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE INVENTION

Figure 1:
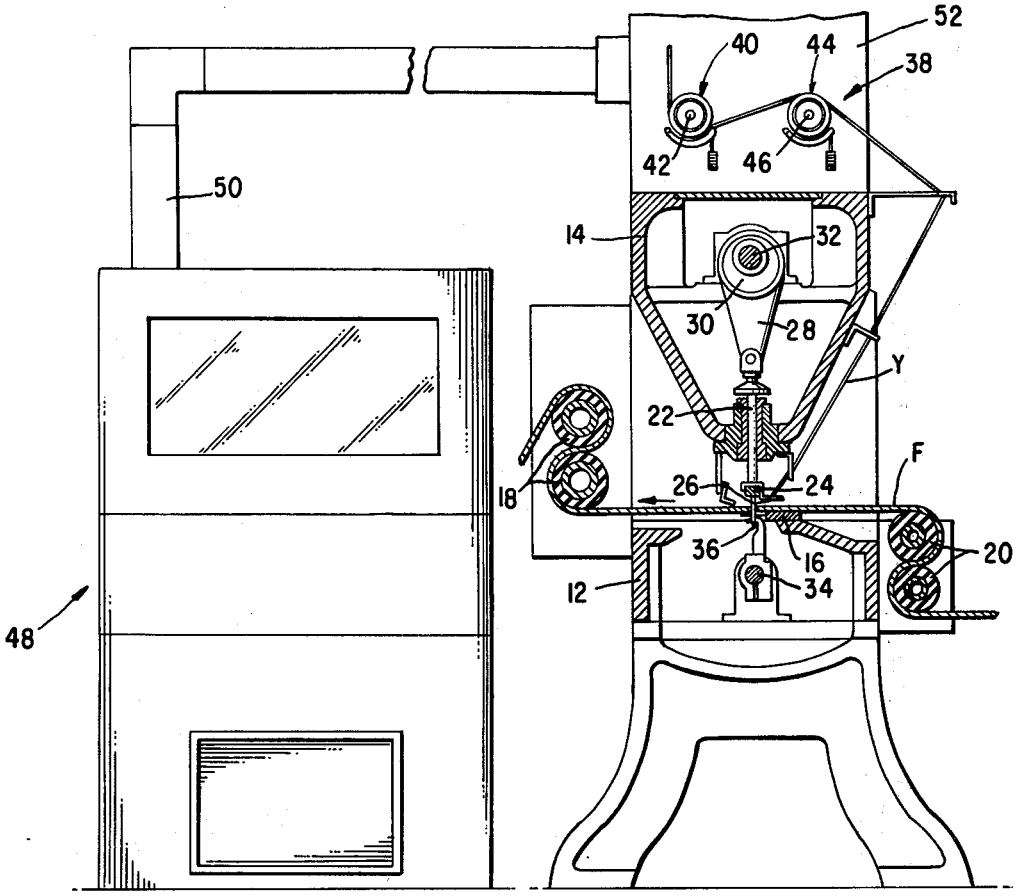
FIG. 1 is a vertical sectional view taken transversely through a multi-needle tufting machine incorporating a yarn feed roller assembly constructed in accordance with a first embodiment of the present invention.

Referring to FIG. 1 a tufting machine 10 is illustrated having a frame comprising a bed 12 and a head 14 disposed above the bed. The bed 12 includes a bed plate 16 across which a fabric F is adapted to be fed by a pair of feed rolls 18 and take-off rolls 20.

Mounted in the head 14 for vertical reciprocation is a push rod 22 to the lower end of which is mounted a needle bar 24 which in turn carries a plurality of needles 26 that are adapted to penetrate the fabric F on the bed plate 16 upon reciprocation of the needle bar 24 and to project loops of yarn therethrough. Endwise reciprocation is imparted to the push rod 22 and thus the needle bar 24 and needles 26 by a link 28 which is pivotably connected at its lower end to the push rod 22 and at its upper end to an eccentric 30 on a driven rotary main shaft 32 that is journalled longitudinally of the head 14. While a plurality of push rods 22, links 28 eccentrics 30 and needles 26 are normally provided along the main shaft 32, only one set thereof is illustrated in the drawings.

Beneath the bed plate 16 there is journalled an oscillating looper shaft 34 which is arranged parallel to the main shaft 32 and which carries a plurality of loopers 36. Each looper 36 cooperates with a needle 26 to seize a loop of yarn presented thereby and holds the same as the needle is withdrawn on its return stroke, after which the looper retracts to release the loop. While to simplify the drawings only a single looper 36 is shown, it is understood that one looper is provided for each needle in the machine.

Yarn Y is fed to the needles 26 by a pattern attachment including a yarn feed roller assembly 38 which may be mounted on the head 14 as illustrated. The assembly 38 includes a multiplicity of low speed rollers 40 mounted on a low speed drive shaft 42 and a multiplicity of high speed rollers 44 mounted on a high speed drive shaft 46. As hereinafter described corresponding low and high speed rollers cooperate to feed a yarn strand selectively at the rate of one or the other of the rollers. As known in the art, one or more other shafts and corresponding rollers may be included in the assembly. The corresponding rollers on the different shafts define a roller set about which yarn is wound to be fed to the needles. Since the amount of yarn supplied to each needle is determined by the speed of the shaft of the selected roller, and since with a fixed needle stroke the amount of yarn supplied to the needle determines the pile height of the pile fabric produced, patterned pile effects may be created by selectively driving the rollers at the speed of one or the other of the drive shafts. The drive shaft selected to be coupled to a particular roller set may be determined by a pattern control mechanism 48 such as illustrated in Irwin et al, U.S. Pat. No. 3,272,163 and Ingham et al, U.S. Pat. No. 3,922,979 to which further reference may be had for a more complete description thereof. Suffice it here to say that the pattern control reads a pattern and transmits signals for each of the roller sets through leads within a conduit 50 to the yarn feed roller assembly 38.

Figure 2:
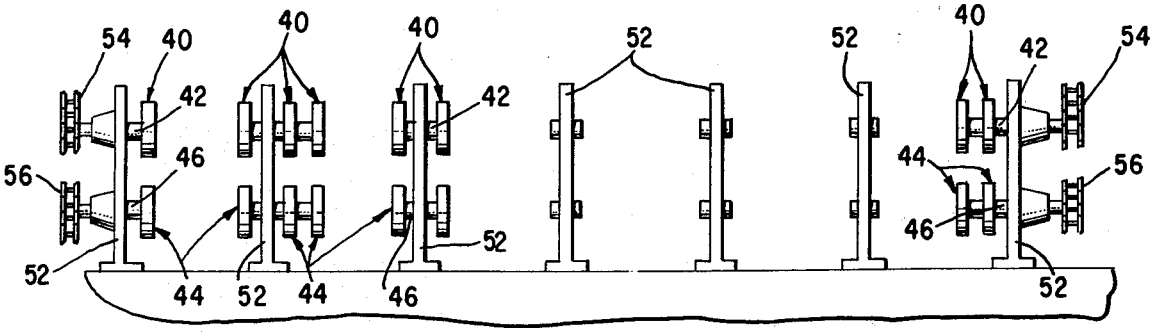
FIG. 2 is a diagrammatic plan view of the feed roller assembly.

The shafts 42 and 46 (and others if a three or more pile height pattern is desired) together with their respective rollers are journally carried by brackets 52 which may be secured to the head 14 of the tufting machine. The drive shafts 42 and 46 may be driven at their ends, as illustrated in FIG. 2, through respective chain and sprocket means 54 and 56 or the like at different speeds in timed relation to the tufting machine. This can be accomplished by driving the chain and sprocket means or like drive means from the main shaft 32 of the tufting machine.

Figure 3:
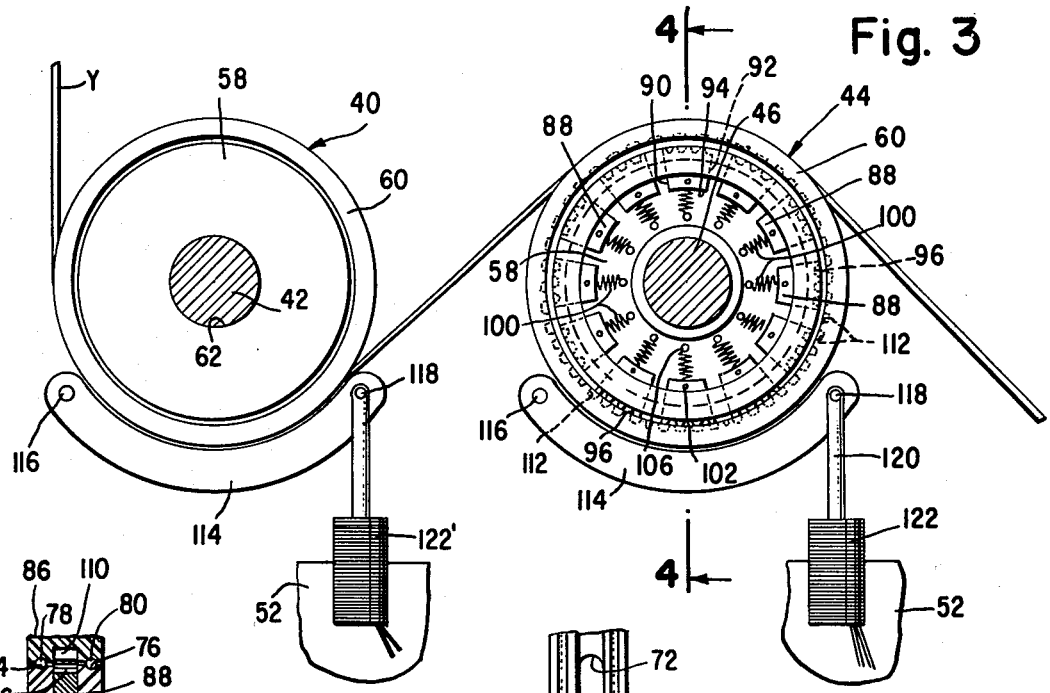
FIG. 3 is an end elevational view of one feed roller set illustrated in FIG. 1, greatly enlarged.
Figure 4:
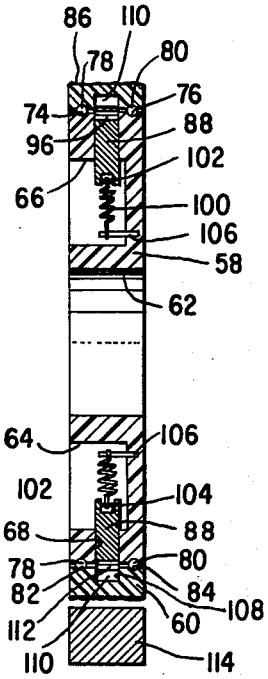
FIG. 4 is a cross sectional view taken through one of the rollers and magnetic force applying member taken substantially along a diagonal line of the roller, such as line 4—4 of FIG. 3.
Figure 5:
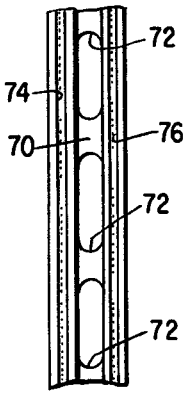
FIG. 5 is a plan view of a fragment of the circumference of the inner race of a roller constructed in accordance with the invention.

Since each of the feed rollers 40 and 44 are of the same construction only roller 44 will be described in detail, it being understood that the description also applies to roller 40. Referring to FIGS. 3 – 5 it is seen that the roller 44 comprises an inner race 58 and an outer race 60. Each of the races preferably comprises a synthetic plastic such as nylon. The inner race is a disk-like member having a substantially central bore 62 through a hub 64 for securing onto the shaft 46 for rotation therewith, and an outer peripheral flange portion 66. The flange 66 has a substantially central circumferential groove 68 extending from the outer peripheral surface radially inwardly to a surface 70, and includes a plurality of circumferentially spaced centrally disposed radial slots 72 through the flange, so that the surface 70 forms a plurality of ribs between the slots 72. On each side of the groove 68 at the peripheral surface there is a circumferential groove 74 and 76 for receiving a bearing means which preferably is a plurality of balls 78 and 80 respectively, for journally supporting the outer race 60 which receives the respective balls in a pair of inner circumferential grooves 82 and 84. The outer peripheral surface of the outer race acts to feed the yarn and may have an abrasive surface 86 for providing a more positive feeding action.

Positioned in each of the radial slots 72 is a drive coupling segment 88 which is sector shaped that it has sides 90 and 92 extending substantially radially but is truncated at its inner peripheral end 94. The outer peripheral surface is arcuately shaped and has a plurality of teeth 96 spaced equally about the surface. Each segment is comprised of magnetic material susceptible to magnetic force and in the preferred embodiment is a ferromagnetic material – steel. In the embodiment of FIGS. 3 – 4 a small coil spring 100 has one end secured to a pin 102 positioned within a groove 104 formed between the faces of the segments 88 at the inner ends 94. The other end of the springs 100 is secured to a pin 106 fixed to the inner disk-like face of the inner race 58. The springs 100 bias the segments 88 to be normally urged radially inwardly away from the outer race 60.

Positioned within a centrally circumferential groove 108 at the inner peripheral surface of the outer race 60 between the grooves 82 and 84 is a drive coupling member 110 which is in the form of a ring having a plurality of teeth spaced equally about the circumference thereof and extending in the direction toward the axis of the races. The teeth 112 are shaped and spaced to cooperate with the teeth 96 of the segments 88 as hereinafter described. The ring 110 may be a ring gear molded into place in the outer race, of the outer race may be formed of two pieces and bonded or glued together about the ring. Preferably the ring comprises a non-magnetic material such as brass.

As the inner race rotates with its shaft the segments 88 also rotate. The outer race can freely rotate relative to the inner race until the segments 88 are forced outwardly into coupling engagement with the member 110 to drive the outer race. To overcome the force of the springs 100 and effect coupling engagement of the segments 88 and ring gear 110 an arcuately shaped magnet 114 is provided. The magnet in this first embodiment is a permanent magnet having one end pivotably mounted on a pin 116 adjacent to the periphery and external of the outer race. Preferably the shape of the magnet conforms to that of the outer race but is of a larger radius. The other end of the magnet is free for movement toward and away from close proximity with the outer race. The free ends of the magnets 114 is connected by a pin 118 to the stems 120 of electrical solenoids 122, or similar actuating means such as pneumatic cylinders, secured to the brackets 52 of the assembly. The solenoids 122 are energized by the signals from the pattern control 48 to selectively move the magnet 114 toward and away from the rollers.

When the pattern calls for a high pile the roller 44 must be positively driven by the high speed shaft 46. The solenoid 122 associated with the high speed unit is energized to move the magnet 114 toward the outer race of roller 44. The magnetic force of the magnet is attractive and it attracts the segments 88 that are located along the arc length of the magnet toward the outer race and into coupling engagement with the ring 110 so that the teeth 96 mesh with the teeth 12 to drive the outer race at the rotational speed of the shaft 46. As the shaft rotates other segments are forced into coupling engagement in seriatim to drive the outer race. Yarn is wound about the surfaces 86 of a set of rollers 44 and 40 and, as in this case, is fed by the high speed roller, while the outer race of the low speed roller 40 rotates freely on its inner race. When the pattern calls for a low pile the solenoid 122 is disenergized and the solenoid 122' associated with the low speed roller is energized to feed the yarn strand. Since the segments 88 are extremely thin the width of the rollers are very narrow relative to prior art feed rollers.

Figure 6:
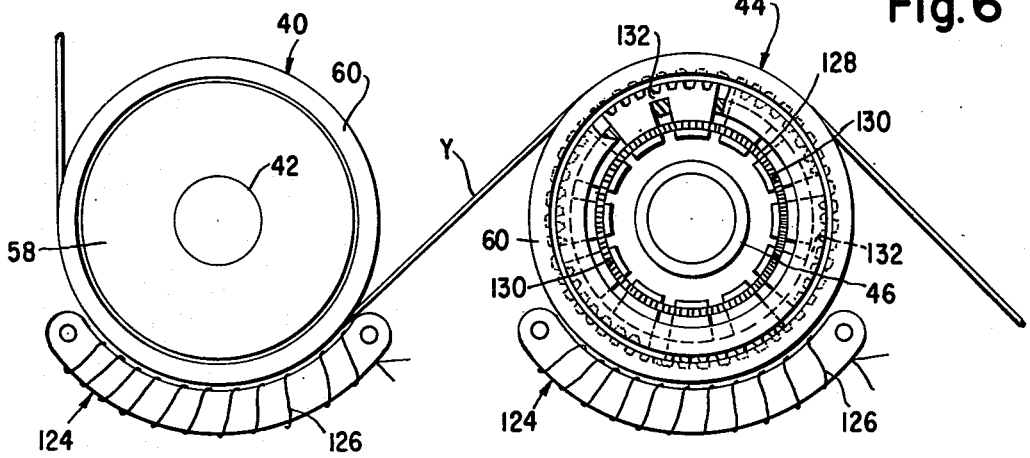
FIG. 6 is a view similar to FIG. 3, but of another embodiment illustrating a number of variations.

The embodiment shown in FIG. 6 is similar to the first embodiment but an electro-magnet 124 is used in place of the permanent magnet 114. The magnet 124 has a multiplicity of turns of wire 126 wound thereabout to provide an attractive magnetic force field to pull the segments into coupling engagement with the outer race. In this embodiment the solenoids can be eliminated since the electro-magnets can be energized directly from the pattern control. Otherwise the operation is the same as that of the first embodiment.

Also shown in the embodiment of FIG. 6 is a single garter spring 128 for biasing the segments. The spring 128 may be positioned within slots 130 formed in a face of the segments. Another variation shown in FIG. 6 is a common periphery 132 formed between two adajacent segments to provide a greater path for the magnetic flux, and thus a more efficient utilization of the force field.

Numerous alterations of the structure herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included wthin the scope of the appended claims.

Having thus described the nature of the invention, what is claimed herein is:

1. In a yarn feed roller assembly including a plurality of drive shafts, a feed roller on each of said shafts comprising, an inner race mounted on the drive shaft for rotation therewith, an outer race associated with the inner race, bearing means intermediate the inner and outer race for journally supporting the outer race on the inner race for rotation relative thereto, said outer race having a yarn engaging surface in the outer periphery and a drive coupling member at the inner periphery, a plurality of drive coupling segments rotatably carried by the inner race and radially movable relative thereto, biasing means for normally urging said segments radially away from the outer race, and actuating means for selectively forcing the segments to overcome the urging of the biasing means and move radially into coupling engagement with said drive coupling member to drive the outer race at the speed of the shaft, whereby yarn wound about corresponding rollers of said shafts may be fed at a rate determined by the speed of one or the other of the drive shafts.

2. In a yarn feed roller assembly as recited in claim 1 wherein said segments comprise a magnetic material susceptible to magnetic force and said actuating means includes magnetic means for applying a magnetic force to the segments.

3. In a yarn feed roller assembly as recited in claim 2 wherein said magnetic means is disposed externally of said outer race and said magnetic force is attractive.

4. In a yarn feed roller assembly as recited in claim 3 wherein said magnetic means comprises a permanent magnet, means for mounting said magnet for movement toward and away from said roller, said actuating means including means for selectively moving said magnet toward and away from said roller for increasing and decreasing the magnetic force applied to said segments.

5. In a yarn feed roller assembly as recited in claim 3 wherein said magnetic means comprises electromagnetic means, and said actuating means includes means for selectively energizing said electromagnetic means.

6. In a yarn feed roller assembly as recited in claim 4 wherein said assembly includes a frame, said magnet being arcuately shaped to conform substantially to an arc of the outer race, said means for mounting said magnet includes journal means for pivotably mounting said magnet for pivotable movement into and away from close proximity with the outer race.

7. In a yarn feed roller assembly as recited in claim 1 wherein said segments include a plurality of teeth on the outer periphery, and said drive coupling member has a plurality of teeth adapted to mesh with the teeth of said segments.

8. In a yarn feed roller assembly as recited in claim 7 wherein said teeth of said drive coupling member comprise an internal ring gear, and means for securing said ring gear to said outer race.

9. In a yarn feed roller assembly as recited in claim 1 wherein said inner race comprises a disk having an outer peripheral flange, means defining spaced radially extending slots in the periphery of said flange, said segments comprising radially shaped segments receivable in said slots.

10. In a yarn feed roller assembly as recited in claim 9 wherein two adjacent segments have a common outer periphery.

11. In a yarn feed roller assembly as recited in claim 3 wherein said segments include a plurality of teeth on the outer periphery, and said drive coupling member has a plurality of teeth adapted to mesh with the teeth of said segments.

12. In a yarn feed roller assembly as recited in claim 3 wherein said drive coupling member comprises a non-magnetic material.

13. In a yarn feed roller assembly as recited in claim 10 wherein said biasing means comprises a garter spring acting on all of said segments.

14. A roller for a feed roller assembly comprising an inner race having a central bore adapted for mounting on a shaft, an outer race, bearing means intermediate the inner and outer race for journally supporting the outer race on the inner race for rotation relative thereto, said outer race having a drive coupling member at the inner periphery, a plurality of drive coupling segments carried by the inner race and radially movable relative thereto, said segments comprising magnetic material susceptible to be moved by magnetic force, and biasing means for normally urging said segments radially away from the outer race.

15. A roller as recited in claim 14 wherein said segments include a plurality of teeth on the outer periphery.

16. A roller as recited in claim 14 wherein said inner race comprises a disk having an outer peripheral flange, means defining spaced radially extending slots in the periphery of said flange, said segments comprising radially shaped segments receivable in said slots.

17. In a multi-needle tufting machine having a yarn feed roller attachment for feeding controlled amounts of yarn to each needle in accordance with a pattern, said attachment including a roller assembly comprising a plurality of drive shafts each rotatably driven at a different speed, at least one corresponding roller on each of said shafts, each roller comprising an inner race mounted on the drive shaft for rotation therewith, an outer race, bearing means intermediate the inner and outer race for journally supporting the outer race on the inner race for rotation relative thereto, said outer race having a yarn engaging surface on the outer periphery and a drive coupling member on the inner periphery, a plurality of drive coupling segments rotatably carried by the inner race and radially movable relative thereto, biasing means for normally urging said segments radially away from the outer race, and actuating means for selectively forcing the segments to overcome the urging of the biasing means and to move radially into coupling engagement with said drive coupling member to drive the outer race at the speed of the shaft, whereby yarn wound about corresponding rollers may be fed at a rate determined by the speed of one or the other of the drive shafts.

* * * * *